US005819832A

United States Patent [19]

Huang

[11] Patent Number: 5,819,832

[45] Date of Patent: Oct. 13, 1998

[54] OPERATING DEVICE FOR A VENETIAN BLIND TO CONTROL RAISING AND LOWERING OF THE SLATS AND TO ADJUST TILTING ANGLE OF THE SLATS

[76] Inventor: Tai-Long Huang, No. 382, Sec. 1, Yuan-Lu Rd., Fu-Hsing Hsiang, Chang Hua Hsien, Taiwan

[21] Appl. No.: 972,513

[22] Filed: Nov. 18, 1997

Related U.S. Application Data

[63] Continuation-in-part of Ser. No. 844,406, Apr. 18, 1997, Pat. No. 5,749,405.

[51] Int. Cl.[6] ..... E06B 9/30

[52] U.S. Cl. ..... 160/168.1 R; 160/176.1 R; 160/178.2 R

[58] Field of Search ..... 160/168.1 R, 173 R, 160/176.1 R, 177 R, 178.1 R, 178.2 R, 107, 172 R, 171 R, 170 R

[56] References Cited

U.S. PATENT DOCUMENTS

| | | | |
|---|---|---|---|
| 5,465,775 | 11/1995 | Biba et al. | 160/178.1 R X |
| 5,472,035 | 12/1995 | Biba et al. | 160/168.1 R |
| 5,501,262 | 3/1996 | Inaba et al. | 160/173 R X |
| 5,553,649 | 9/1996 | Chisaka et al. | 160/178.2 R X |
| 5,553,653 | 9/1996 | Rozon | 160/178.1 R X |
| 5,645,685 | 7/1997 | Furhman | 160/168.1 R |

*Primary Examiner*—David M. Purol
*Attorney, Agent, or Firm*—Ladas & Parry

[57] ABSTRACT

An operating device for a Venetian blind includes a positioning tube coupled to the shaft of the Venetian blind and formed with a top opening and an axially extending slot. An annular stop member is disposed in the receiving space adjacent to the top wall and has an inner surface that confines a tapered central hole which tapers upwardly. A retaining member is axially movable in the positioning tube, and has a tapered upper end portion which complements the tapered central hole and which is extendible into the tapered central hole. A biasing spring biases the retaining member upwardly so that pull ropes which extend through the positioning tube can be clamped between the tapered upper end portion and the stop member. An elongated sleeve is disposed around the positioning tube and is formed with a radial hole that is aligned with the pin hole. An insert pin extends through the radial hole, the slot and the pin hole. The elongated sleeve is movable downwardly relative to the positioning tube so as to move the tapered upper end portion downwardly away from the stop member for releasing the pull ropes.

7 Claims, 5 Drawing Sheets

OPERATING DEVICE FOR A VENETIAN BLIND TO CONTROL RAISING AND LOWERING OF THE SLATS AND TO ADJUST TILTING ANGLE OF THE SLATS

CROSS-REFERENCE TO RELATED APPLICATION

This application is a continuation-in-part (CIP) of U.S. patent application Ser. No. 08/844,406, filed on Apr. 18, 1997 now U.S. Pat. No. 5,749,405

BACKGROUND OF THE INVENTION

1. Field of the Invention

The present invention relates to an operating device for a Venetian blind to control raising and lowering of the slats and to adjust tilting angle of the slats, more particularly to an operating device which combines the functions of controlling raising and lowering of the slats and adjusting tilting angle of the slats in a single structure and which is capable of clamping effectively and releasably pull ropes of the Venetian blind.

2. Description of the Related Art

Referring to FIG. 1, a conventional Venetian blind is shown to include an elongated housing 1, a horizontally disposed shaft 2 journalled in the housing 1, a plurality of slats 5 suspended one above another from the housing 1, a bottom rail 7 disposed below the slats 5, a plurality of pull ropes 6, each of which has a first end that passes through the housing 1 and through the slats 5 and that is mounted to the bottom rail 7, and a second end that extends out of the housing 1, a lock unit 8 provided at one end of the housing 1 for clamping releasably the pull ropes 6, a plurality of pairs of tilting cords 4 disposed at longitudinal sides of each of the slats 5 and having top ends secured to the shaft 2 and bottom ends secured to the bottom rail 7, a plurality of suspending strings (not shown) disposed below each of the slats 5 to interconnect the tilting cords 4, and a tilt control unit 9 coupled to the shaft 2 for controlling tilting of the slats 5.

In the conventional Venetian blind, the tilt control unit 9 for controlling tilting of the slats 5 is separate from the lock unit 8 for controlling raising and lowering of the slats 5. The conventional Venetian blind is thus inconvenient to operate and has a disorderly appearance.

U.S. patent application Ser. No. 08/844,406 by the Applicant discloses an operating device which combines the functions of controlling raising and lowering of the slats and adjusting tilting angle of the slats in a single structure. The operating device includes a rotary tilt control unit, a positioning tube, a retaining member, a biasing spring, an elongated sleeve and an insert pin. The rotary tilt control unit has a first end adapted to be coupled to the shaft of a Venetian blind such that axial rotation of the tilt control unit results in corresponding axial rotation of the shaft to adjust tilting angles of slats of the Venetian blind. The positioning tube is connected to a second end of the tilt control unit, and has a top wall formed with a top opening and a surrounding wall extending downwardly from a periphery of the top wall. The top wall and the surrounding wall cooperatively confine a receiving space. The top opening is adapted to permit extension of pull ropes of the Venetian blind through the positioning tube. The surrounding wall has an axially extending slot unit formed therethrough. The retaining member is axially movable in the receiving space of the positioning tube. The retaining member has a tapered upper end portion which is extendible through the top opening of the positioning tube, a hollow lower end portion and a radial pin hole aligned with the slot unit. The retaining member is provided with a pair of axially extending guiding grooves for receiving the pull ropes. Each of the guiding grooves has a depth not greater than the diameter of each of the pull ropes. The biasing spring is disposed in the positioning tube under the retaining member for biasing the retaining member upwardly so that the pull ropes can be clamped between the tapered upper end portion of the retaining member and the top wall of the positioning tube. The elongated sleeve is disposed around the positioning tube, and is formed with a radial hole that is aligned with the pin hole of the retaining member. The elongated sleeve has a length sufficient to conceal major portions of the pull ropes that extend out of the positioning tube. The elongated sleeve further has an outer surface with at least one hook projection adapted for hooking end portions of the pull ropes that extend out of the elongated sleeve thereon. The insert pin extends through the radial hole of the elongated sleeve, the slot unit of the positioning tube and into the pin hole of the retaining member. The elongated sleeve is movable downwardly relative to the positioning tube so that the insert pin and the retaining member are moved downwardly against biasing action of the biasing spring together with the elongated sleeve, thereby retracting the tapered upper end portion of the retaining member into the positioning tube for releasing the pull ropes.

It is desirable to improve the aforementioned operating device to result in an enhanced pull ropeclamping effect.

SUMMARY OF THE INVENTION

The main object of the present invention is to provide an operating device for a Venetian blind which combines the functions of controlling raising and lowering of slats and adjusting tilting angle of the slats in a single structure, and which is capable of clamping effectively and releasably pull ropes of the Venetian blind.

Accordingly, the operating device of the present invention is adapted for use with a Venetian blind which includes an elongated top housing, a horizontally disposed shaft journalled in the top housing, a plurality of horizontal slats suspended one above another from the top housing, a bottom rail disposed below the slats, a pair of pull ropes, each of the pull ropes having a first end which passes through the housing and through the slats and which is mounted to the bottom rail, and a second end which extends out of the housing, and a plurality of pairs of tilting cords disposed on opposite longitudinal sides of the slats and having upper ends secured to the shaft and lower ends mounted on the bottom rail. The operating device includes a positioning tube, an annular stop member, a retaining member, a biasing spring, an elongated sleeve and an insert pin. The positioning tube is adapted to be coupled to the shaft of the Venetian blind such that axial rotation of the positioning tube results in corresponding axial rotation of the shaft to adjust tilting angles of the slats. The positioning tube has a top wall formed with a top opening and a surrounding wall extending downwardly from a periphery of the top wall. The top wall and the surrounding wall cooperatively confine a receiving space. The top opening is adapted to permit extension of the second ends of the pull ropes through the positioning tube. The surrounding wall has an axially extending slot unit formed therethrough. The annular stop member is disposed in the receiving space adjacent to the top wall. The stop member has an inner surface that confines a tapered central hole which tapers upwardly and which is aligned with the top opening so as to be adapted to permit extension of the second ends of the pull ropes therethrough. The retaining member is axially movable in the receiving space of the positioning tube. The retaining member has a tapered upper end portion which complements the tapered central hole of the stop member and which is extendible into the tapered central hole, a pair of axially extending guiding grooves which are adapted to receive the pull ropes, and a radial pin hole aligned with the slot unit. Each of the guiding grooves has a section which is located at the tapered end portion of the retaining member and which has a depth not greater than the diameter of each of the pull ropes. The biasing spring is disposed in the positioning tube under the retaining member for biasing the retaining member upwardly so that the pull ropes can be clamped between the tapered upper end portion of the retaining member and the inner surface of the stop member. The elongated sleeve is disposed around the positioning tube and is formed with a radial hole that is aligned with the pin hole of the retaining member. The insert pin extends through the radial hole of the elongated sleeve, the slot unit of the positioning tube and the pin hole of the retaining member. The elongated sleeve is movable downwardly relative to the positioning tube so that the insert pin and the retaining member are moved downwardly against biasing action of the biasing spring together with the elongated sleeve, thereby moving the tapered upper end portion of the retaining member away from the inner surface of the stop member for releasing the pull ropes.

BRIEF DESCRIPTION OF THE DRAWINGS

Other features and advantages of the present invention will become apparent in the following detailed description of the preferred embodiment with reference to the accompanying drawings, of which.

DETAILED DESCRIPTION OF THE PREFERRED EMBODIMENT

Figure 1:
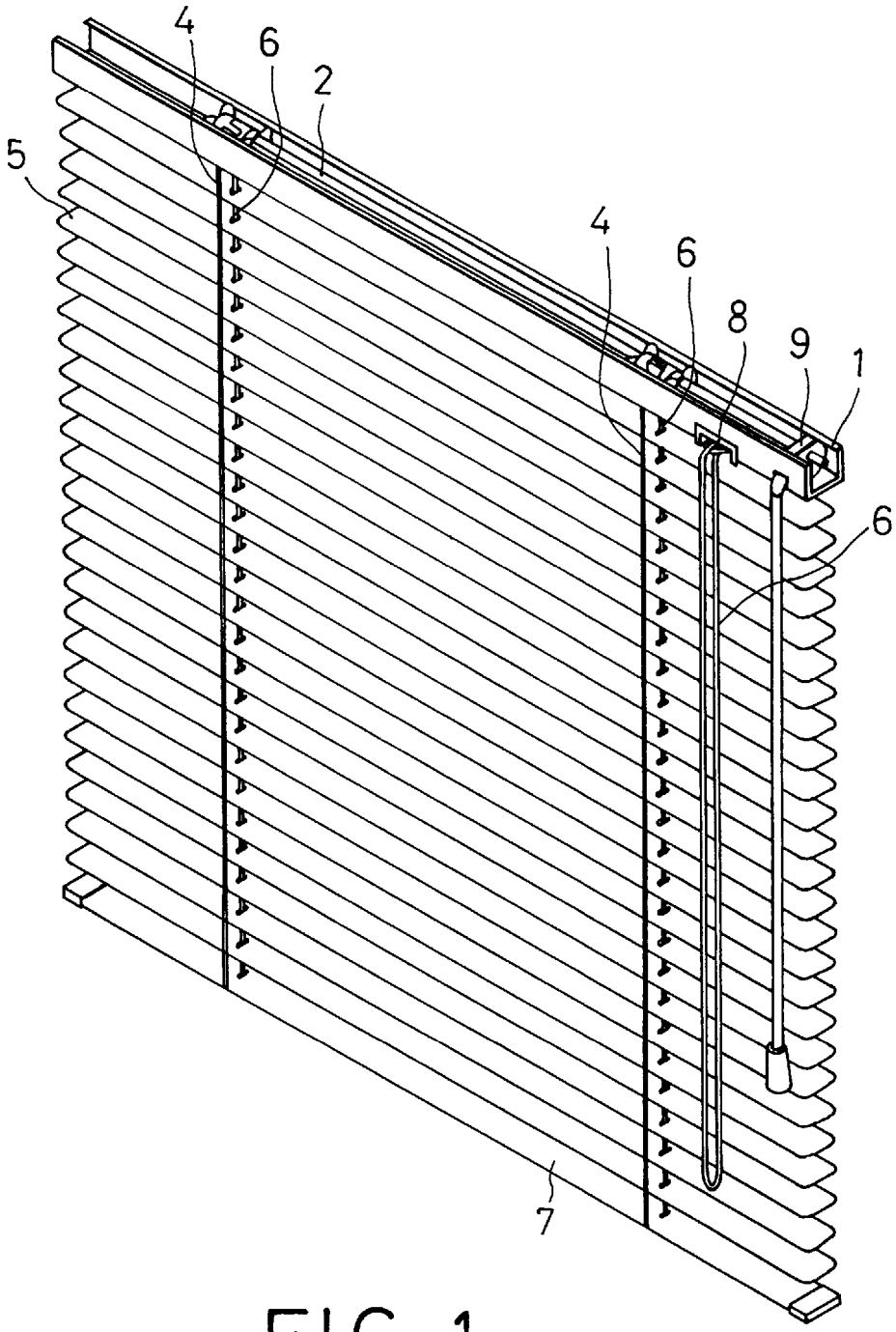
FIG. 1 PRIOR ART
FIG. 1 illustrates a conventional Venetian blind.

The operating device of the present invention is adapted for use with a conventional Venetian blind, such as that shown in FIG. 1, which includes an elongated top housing, a horizontally disposed shaft journalled in the top housing, a plurality of horizontal slats suspended one above another from the top housing, a bottom rail disposed below the slats, a pair of pull ropes, each of which has a first end that passes through the housing and through the slats and that is mounted to the bottom rail, and a second end that extends out of the housing, a plurality of pairs of tilting cords disposed on opposite longitudinal sides of the slats and having upper ends secured to the shaft and lower ends mounted on the bottom rail, and a plurality of suspending strings disposed below each of the slats for interconnecting the tilting cords.

Figure 2:
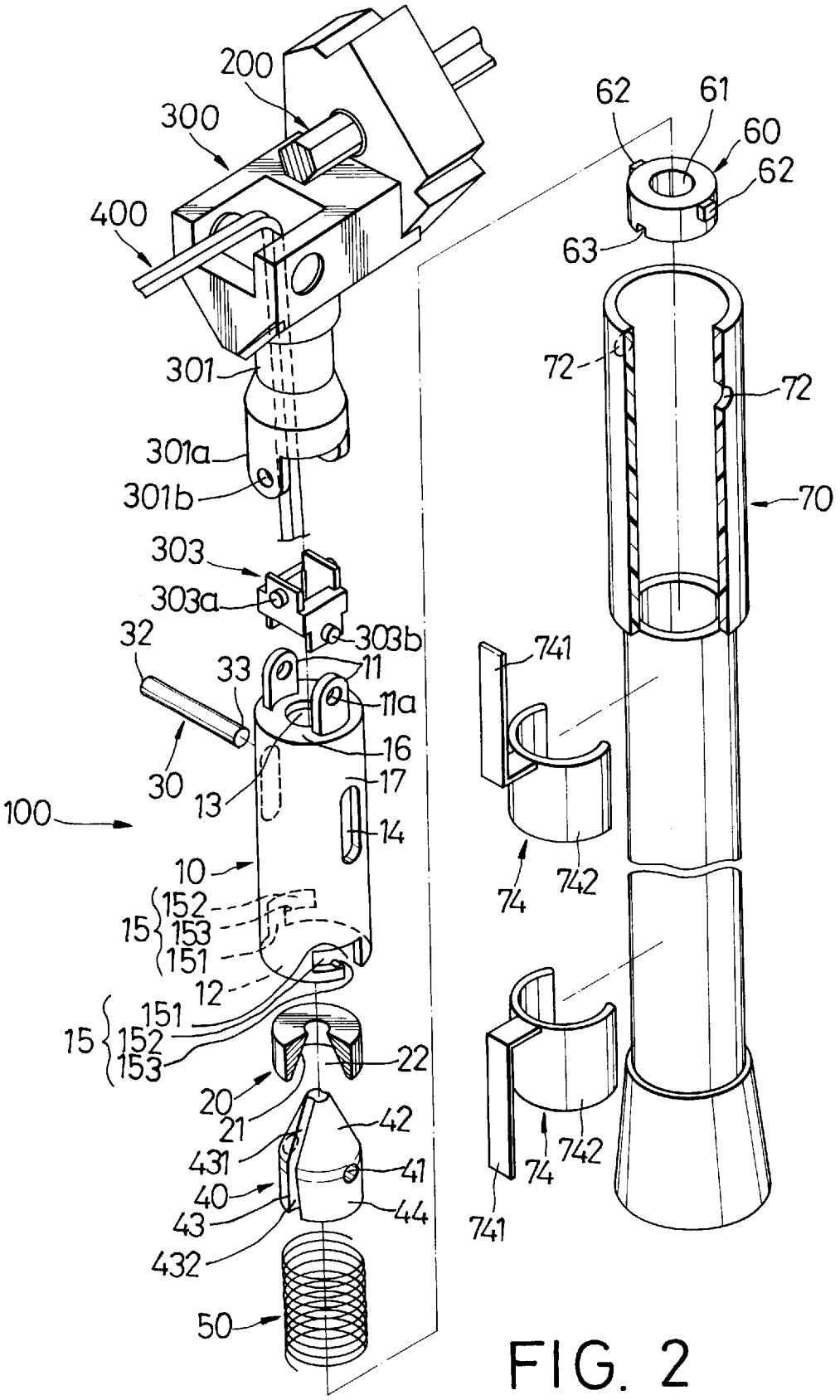
FIG. 2 is an exploded perspective view illustrating an operating device according to a preferred embodiment of the present invention.

Referring to FIG. 2, the operating device 100 according to a preferred embodiment of the present invention includes a rotary tilt control unit 300, a positioning tube 10, an annular stop member 20, a retaining member 40, a biasing spring 50, a positioning member 60, an elongated sleeve 70 and an insert pin 30.

The tilt control unit 300 is adapted to be coupled to the shaft 200 of the Venetian blind and has a tubular connector 301 which is adapted to extend out of the top housing of the Venetian blind and to permit passage of the second ends of the pull ropes 400 therethrough. The tubular connector 301 is rotatable axially to result in axial rotation of the shaft 200 in a known manner. The tubular connector 301 has a lower end formed with a pair of diametrically opposite, downwardly extending first pivot lobes 301*a*, each of which has a first pivot hole 301*b* formed therethrough.

The positioning tube 10 has an upper end formed with a pair of diametrically opposite, upwardly extending second pivot lobes 11, each of which has a second pivot hole 11*a* formed therethrough. An annular connector 303 is disposed between the upper end of the positioning tube 10 and the lower end of the tubular connector 301 to interconnect the positioning tube 10 and the tubular connector 301. The annular connector 303 has an opposite pair of first radial protrusions 303*a* which extend rotatably and respectively into the first pivot holes 301*b* in the first pivot lobes 301*a* of the tubular connector 301 for pivotal connection with the tubular connector 301 about a first axis. The annular connector 303 further has an opposite pair of second radial protrusions 303*b* which extend rotatably and respectively into the second pivot holes 11*a* in the second pivot lobes 11 of the positioning tube 10 for pivotal connection with the positioning tube 10 about a second axis perpendicular to the first axis. In this manner, a universal pivot joint is formed between the positioning tube 10 and the tubular connector 301 of the tilt control unit 300. Axial rotation of the positioning tube 10 will result in corresponding axial rotation of the tubular connector 301 and the shaft 200 of the Venetian blind.

The positioning tube 10 is formed as a hollow body and has a top wall 16 formed with a top opening 13 and a surrounding wall 17 extending downwardly from a periphery of the top wall 16. The top wall 16 and the surrounding wall 17 cooperatively confine a receiving space 12. The top opening 13 is adapted to permit extension of the second ends of the pull ropes 400 into the receiving space 12. The surrounding wall 17 has a pair of diametrically opposite, axially extending slots 14 formed therethrough. The surrounding wall 17 is further formed with an opposite pair of retaining slots 15 which extend from a lower end of the positioning tube 10 and through the surrounding wall 17. Each of the retaining slots 15 includes an axially extending entrance section 151 and a circumferentially extending retaining section 152. The entrance section 151 and the retaining section 152 of each of the retaining slots 15 are perpendicular to one another to cooperatively constitute an L-shaped formation. Each of the retaining slots 15 has a resilient retaining projection 153 formed between the entrance section 151 and the retaining section 152.

The annular stop member 20 is disposed in the receiving space 12 of the positioning tube 10 adjacent to the top wall 16. In the present embodiment, the annular stop member 20 is fixed to the top wall 16. The stop member 20 has an inner surface 21 that confines a tapered central hole 22 which tapers upwardly and which is aligned with the top opening 13 of the positioning tube 10 so as to be adapted to permit extension of the second end of the pull ropes 400 therethrough.

The retaining member 40 is received in the receiving space 12 of the positioning tube 10 and is axially movable in the positioning tube 10. The retaining member 40 has a cylindrical lower end portion 44 and a tapered upper end portion 42 which complements the tapered central hole 22 of the stop member 20 and which is extendible into the tapered central hole 22. The retaining member 40 further has a radial pin hole 41 formed therethrough, and an outer surface formed with a pair of axially extending guiding grooves 43 which are adapted to receive the pull ropes 400. Each of the guiding grooves 43 has an upper section 431 which is located at the tapered upper end portion 42 and which has a depth not greater than the diameter of each of the pull ropes 400 so that the sections of the pull ropes 400 that are received in the upper sections 431 of the guiding grooves 43 protrude from the outer surface of the retaining member 40. Each of the guiding grooves 43 further has a lower section 432 which is located at the cylindrical lower end portion 44 and which has a depth greater than the diameter of each of the pull ropes 400 so that the sections of the pull ropes 400 that are received in the lower section 432 of the guiding grooves 43 can be guided inwardly.

The biasing spring 50 is in the form of a coiled compression spring in the present embodiment, and is disposed in the receiving space 12 of the positioning tube 10 immediately under the retaining member 40. The biasing spring 50 has an upper end abutting against a lower end face of the retaining member 40 for biasing the retaining member 40 upwardly so that the tapered upper end portion 42 of the retaining member 40 extends into the tapered central hole 22 of the stop member 20 so as to be adapted to clamp the pull ropes 400 between the tapered upper end portion 42 of the retaining member 40 and the inner surface 21 of the stop member 20.

The positioning member 60 is annular in shape and formed with a central opening 61 that is adapted to permit passage of the second ends of the pull ropes 400 therethrough. The positioning member 60 is disposed at the lower end of the positioning tube 10 and is formed with an opposite pair of radial engaging protrusions 62 which are extendible into the retaining slots 15 via the entrance sections 151. Axial rotation of the positioning member 60 relative to the positioning tube 10 after the radial engaging protrusions 62 extend into the entrance sections 151 of the retaining slots 15 can cause the engaging protrusions 62 to move past the resilient retaining projections 153 for retention in the retaining sections 152. The resilient retaining projections 153 prevent undesired removal of the engaging protrusions 62 of the positioning member 60 from the retaining sections 152 so as to position the positioning member 60 at the lower end of the positioning tube 10. The biasing spring 50 has a lower end abutting against the positioning member 60. The positioning member 60 has a lower end formed with a groove 63 which is adapted to engage a tool bit for rotating the positioning member 60 relative to the positioning tube 10.

The elongated sleeve 70 has an upper section disposed around the positioning tube 10 and formed with a pair of diametrically opposed radial holes 72 which are aligned with the pin hole 41 of the retaining member 40. The elongated sleeve 70 has a length sufficient to conceal major portions of the pull ropes 400 that extend out of the positioning tube 10.

The insert pin 30 extends through the radial holes 72 of the elongated sleeve 70, the radial slots 14 of the positioning tube 10, and the pin hole 41 of the retaining member 40. The insert pin 30 has two opposite ends 32, 33 which are retained in the radial holes 72 of the elongated sleeve 70 (see FIG. 4) so that the positioning tube 10 is rotatable together with the elongated sleeve 70 and so that the elongated sleeve 70 is slidable axially relative to the positioning tube 10.

Each of the retaining rings 74 includes a ring portion 742 sleeved securely on an outer surface of the elongated sleeve 70, and an L-shaped hook projection 741 extending integrally from the ring portion 742. The retaining rings 74 in the present embodiment include an upper one with the hook projection 741 extending upward and a lower one with the hook projection 741 extending downward. The end portions of the pull ropes 400 that extend out of the elongated sleeve 70 may be wound around both of the hook projections 741 and hooked on one of the hook projections 741.

Figure 3:
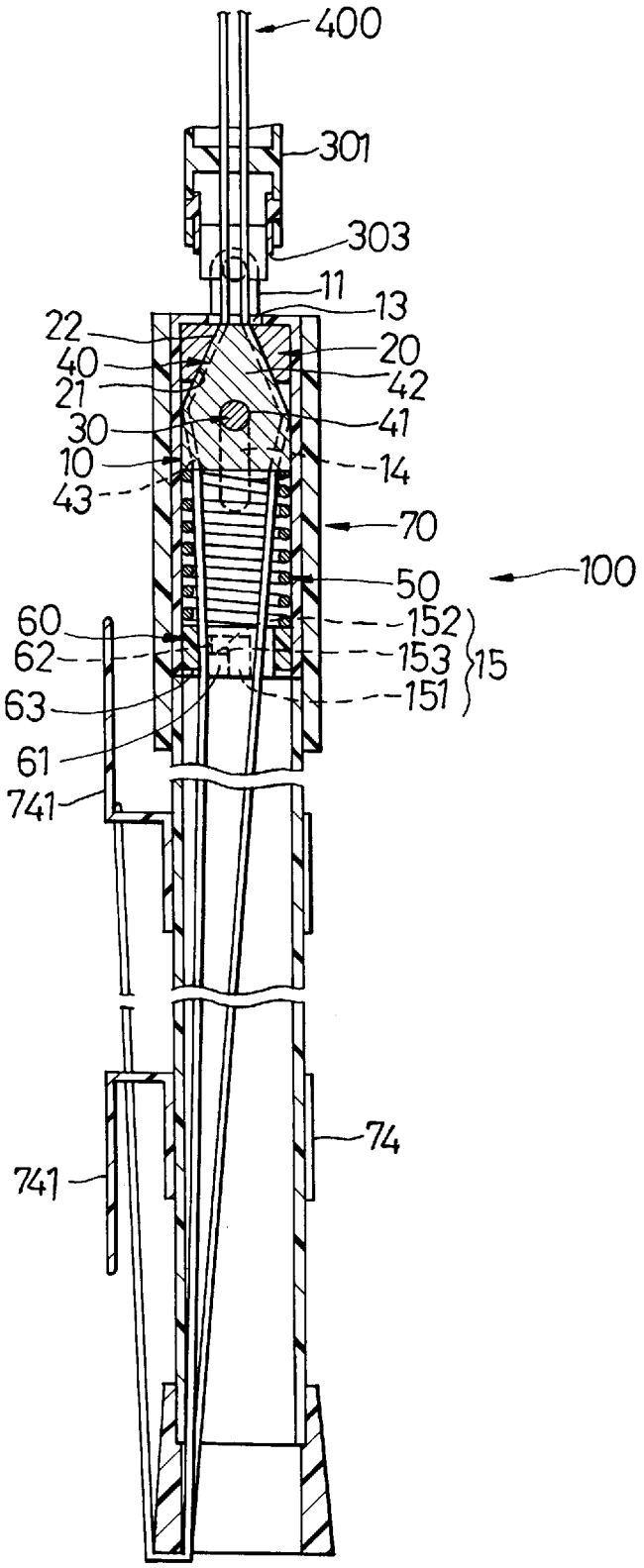
FIG. 3 is longitudinal sectional view of the preferred embodiment when installed on a Venetian blind.
Figure 4:
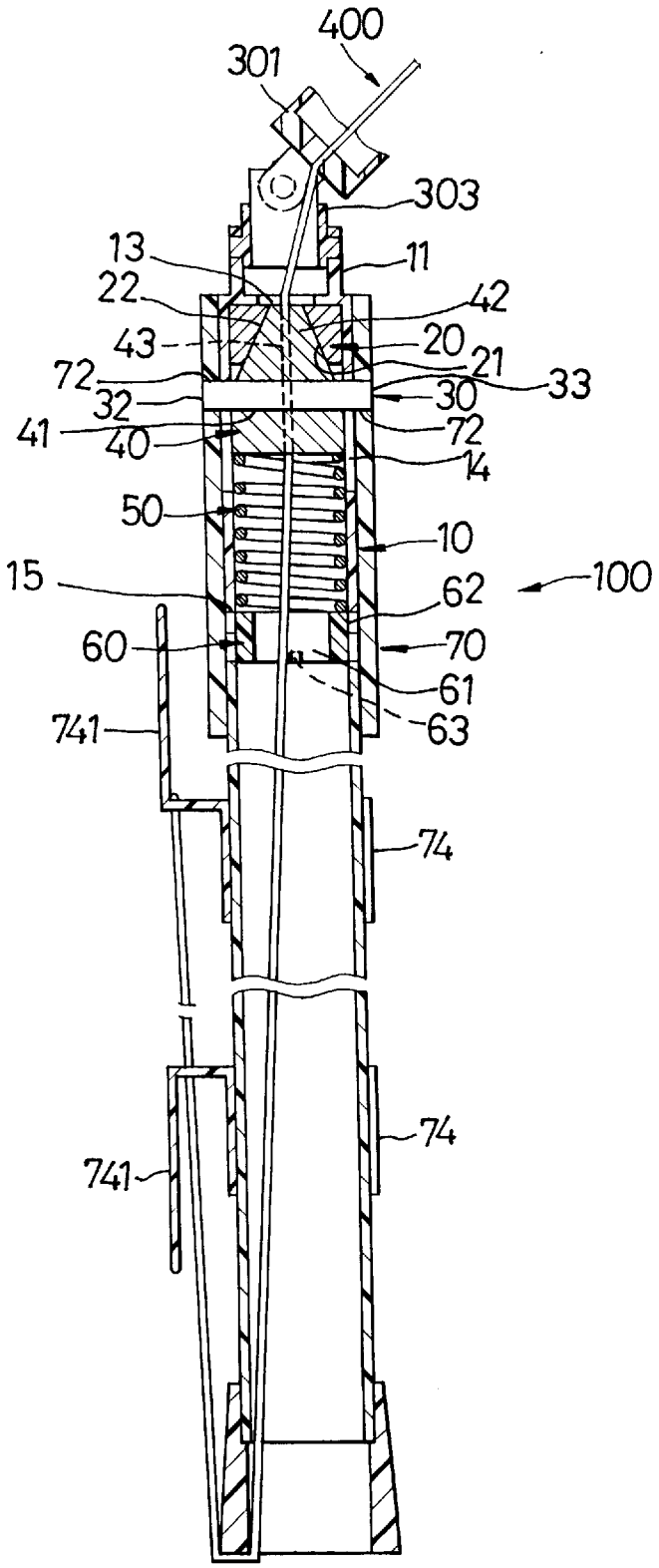
FIG. 4 is another longitudinal sectional view of the preferred embodiment.

Referring to FIGS. 3 and 4, after the operating device 100 has been installed on a Venetian blind, the pull ropes 400 pass through the tubular connector 301, the annular connector 303, the top opening 13 of the positioning tube 10, the tapered central hole 22 of the stop member 20, the guiding grooves 43 of the retaining member 40, the biasing spring 50, the positioning member 60, and extend out of the elongated sleeve 70. End portions of the pull ropes 400 that extend out of the elongated sleeve 70 can be hooked on one of the hook projections 741 to prevent access by children thereto. Normally, the retaining member 40 is biased upwardly by the biasing spring 50 so that the tapered upper end portion 42 of the retaining member 40 extends into the tapered central hole 22 of the stop member 20. The pull ropes 400 are thus tightly clamped between the retaining member 40 and the inner surface 21 of the stop member 20, thereby positioning the slats of the Venetian blind. At this time, the insert pin 30 is located at upper ends of the slots 14 of the positioning tube 10.

To raise the slats, the end portions of the pull ropes 400 are released from the hook projection 741 and are pulled downwardly so that the retaining member 40 is actuated by the pull ropes 400 to move axially in the positioning tube 10 away from the inner surface 21 of the stop member 20. At this time, the biasing spring 50 is slightly compressed. After the slats are adjusted to a desired position, the pulling force applied to the end portions of the pull ropes 400 is released so that the retaining member 40 returns to its biased position to clamp the pull ropes 400 against the inner surface 21 of the stop member 20 so as to position the slats. The end portions of the pull ropes 400 may be wound around the hook projections 741 and hooked on one of the hook projections 741.

Figure 5:
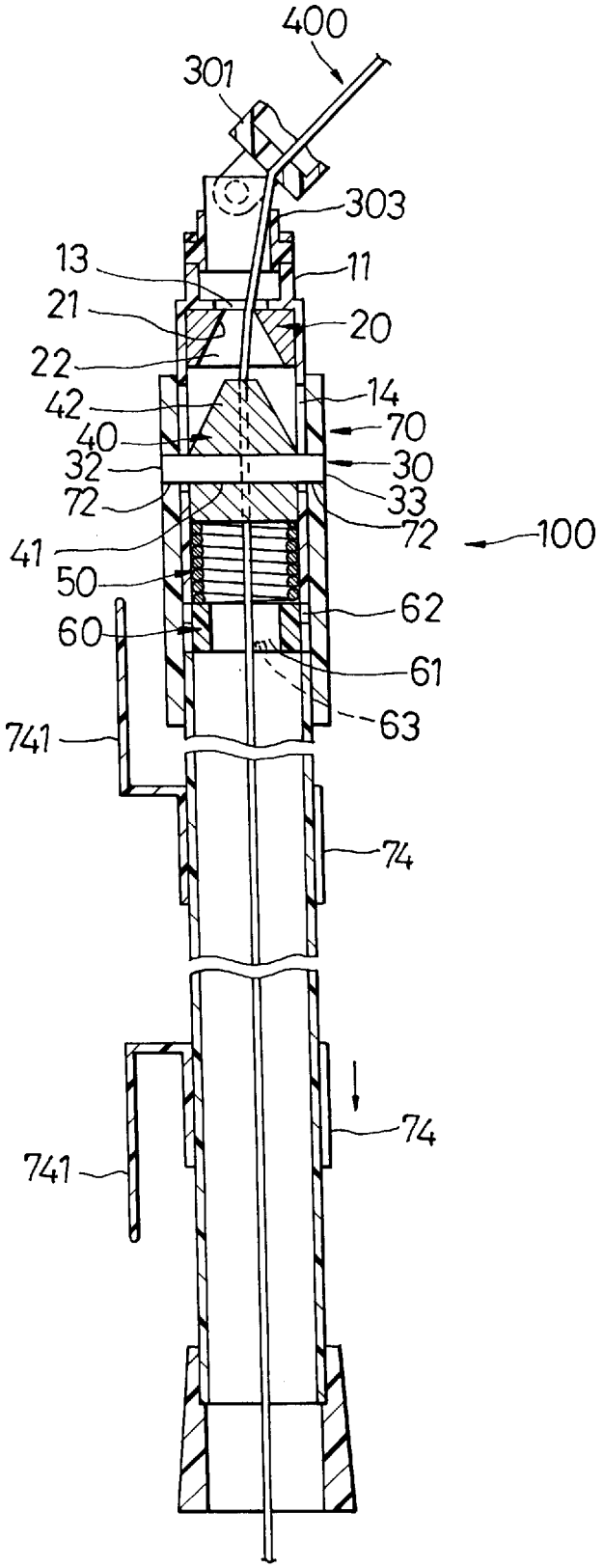
FIG. 5 is still another longitudinal sectional view of the preferred embodiment illustrating how the operating device is operated to release pull ropes of the Venetian blind.

Referring to FIG. 5, to lower the slats of the Venetian blind, the elongated sleeve 70 is pulled downwardly, thereby causing corresponding downward movement of the insert pin 30 from upper ends of the slots 14 to lower ends of the same. The retaining member 40 is thus moved downwardly against biasing action of the biasing spring 50 away from the tapered central hole 22 of the stop member 20. Under this condition, the pull ropes 400 are not clamped between the retaining member 40 and the inner surface 21 of the stop member 20, and the slats are allowed to be lowered due to the weight of the bottom rail. When the slats are lowered to a desired position and are to be positioned thereat, the downward force applied to the elongated sleeve 70 is released. At this time, the biasing spring 50 provides a restoring force to the retaining member 40 for moving the retaining member 40 together with the insert pin 30 upwardly so that the elongated sleeve 70 is moved upwardly by the insert pin 30. At this time, the retaining member 40 returns to its biased position for clamping the pull ropes 400 against the inner surface 21 of the stop member 20 to position the slats.

To adjust the tilting angle of the slats, the elongated sleeve 70 is rotated axially to rotate the insert pin 30 and the positioning tube 10 simultaneously therewith. Since the positioning tube 10 is connected to the tubular connector 301 through a universal joint, the tubular connector 301 can be rotated axially, thereby causing corresponding axial rotation of the shaft 200 (see FIG. 2) of the Venetian blind so as to tilt the slats.

It should be noted that, in this embodiment, the positioning tube 10 is formed with a pair of slots 14, while the elongated sleeve 70 is formed with a pair of radial holes 72. Alternatively, the positioning tube 10 may be formed with only one slot 14, while the elongated sleeve 70 may be formed with only one radial hole 72. In this case, the insert pin 30 is still extendible through the radial hole 72 of the elongated sleeve 70 and the slot 14 of the positioning tube 10 and into the pin hole 41 of the retaining member 40.

It has thus been shown that the operating device 100 of the present invention has combined functions of controlling raising and lowering of the slats and adjusting tilting angle of the slats. Moreover, with the use of the stop member 20 having a tapered central hole 22 and the retaining member 40 having a tapered upper end portion 42 that complements the tapered central hole 22, the operating device 100 of the present invention is capable of clamping the pull ropes 400 more effectively. In the illustrated embodiment, the exposed end portions of the pull ropes 400 that extend out of the elongated sleeve 70 can be hooked on one of the hook projections 741 to prevent access by children thereto.

With this invention thus explained, it is apparent that numerous modifications and variations can be made without departing from the scope and spirit of this invention. It is therefore intended that this invention be limited only as indicated in the appended claims.

I claim:

1. An operating device for a Venetian blind which includes an elongated top housing, a horizontally disposed shaft journalled in the top housing, a plurality of horizontal slats suspended one above another from the top housing, each of the slats having two opposite longitudinal sides, a bottom rail disposed below the slats, a pair of pull ropes, each of the pull ropes having a first end which passes through the housing and through the slats and which is mounted to the bottom rail, and a second end which extends out of the housing, and a plurality of pairs of tilting cords disposed on the opposite longitudinal sides of the slats and having upper ends secured to the shaft and lower ends mounted on the bottom rail, said operating device comprising:

a positioning tube adapted to be coupled to the shaft of the Venetian blind such that axial rotation of said positioning tube results in corresponding axial rotation of the shaft to adjust tilting angles of the slats, said positioning tube having a top wall formed with a top opening and a surrounding wall extending downwardly from a periphery of said top wall, said top wall and said surrounding wall cooperatively confining a receiving space, said top opening being adapted to permit extension of the second ends of the pull ropes through said positioning tube, said surrounding wall having an axially extending slot unit formed therethrough;

an annular stop member disposed in said receiving space adjacent to said top wall, said stop member having an inner surface that confines a tapered central hole which tapers upwardly and which is aligned with said top opening so as to be adapted to permit extension of the second ends of the pull ropes therethrough;

a retaining member axially movable in said receiving space of said positioning tube, said retaining member having a tapered upper end portion which complements said tapered central hole of said stop member and which is extendible into said tapered central hole, a pair of axially extending guiding grooves which are adapted to receive the pull ropes, and a radial pin hole aligned with said slot unit, each of said guiding grooves having a section which is located at said tapered end portion of said retaining member and which has a depth not greater than diameter of each of the pull ropes;

a biasing spring disposed in said positioning tube under said retaining member for biasing said retaining member upwardly so that the pull ropes can be clamped between said tapered upper end portion of said retaining member and said inner surface of said stop member;

an elongated sleeve disposed around said positioning tube and formed with a radial hole aligned with said pin hole of said retaining member; and an insert pin extending through said radial hole of said elongated sleeve, said slot unit of said positioning tube and said pin hole of said retaining member;

said elongated sleeve being movable downwardly relative to said positioning tube so that said insert pin and said retaining member are moved downwardly against biasing action of said biasing spring together with said elongated sleeve, thereby moving said tapered upper end portion of said retaining member away from said inner surface of said stop member for releasing the pull ropes.

2. The operating device according to claim 1, wherein said elongated sleeve has a length sufficient to conceal major portions of the pull ropes that extend out of said positioning tube, said elongated sleeve further having an outer surface provided with at least one hook projection adapted for hooking end portions of the pull ropes that extend out of said elongated sleeve thereon.

3. The operating device according to claim 2, further comprising at least one retaining ring which is sleeved on said elongated sleeve and which has said hook projection formed thereon.

4. The operating device according to claim 1, wherein said positioning tube has a lower end, said surrounding wall of said positioning tube being formed with an opposite pair of L-shaped retaining slots that extend from said lower end, each of said retaining slots including an axially extending entrance section and a retaining section perpendicular to said entrance section, said operating device further comprising a positioning member disposed at said lower end of said positioning tube and formed with a central opening that is adapted to permit passage of the second ends of the pull ropes therethrough, said positioning member being formed with an opposite pair of engaging protrusions which are extendible into said retaining slots via said entrance sections for retention in said retaining sections, said biasing spring having a lower end abutting against said positioning member.

5. The operating device according to claim 4, wherein each of said retaining slots has a resilient retaining projection formed between said entrance section and said retaining section to prevent undesired removal of a respective one of said engaging protrusions from said retaining section.

6. The operating device according to claim 4, wherein said positioning member has a lower end formed with a groove which is adapted to engage a tool bit for rotating said positioning member relative to said positioning tube.

7. The operating device according to claim 1, further comprising a rotary tilt control unit which is adapted to couple said positioning tube to the shaft of the Venetian blind, said tilt control unit including a tubular connector which is adapted to permit extension of the second ends of the pull ropes therethrough, said tubular connector having a lower end formed with a pair of diametrically opposite first pivot lobes which extend downward and which are formed with first pivot holes, respectively, said positioning tube having an upper end formed with a pair of diametrically opposite second pivot lobes which extend upward and which are formed with second pivot holes, respectively, said tilt control unit further including an annular connector disposed between said lower end of said tubular connector and said upper end of said positioning tube, said annular connector having an opposite pair of first radial protrusions which extend rotatably into said first pivot holes in said first pivot lobes of said tubular connector for connecting pivotally said annular connector to said tubular connector about a first axis, said annular connector further having an opposite pair of second radial protrusions which extend rotatably into said second pivot holes in said second pivot lobes of said positioning tube for connecting pivotally said annular connector to said positioning tube about a second axis perpendicular to said first axis.

* * * * *